US006257850B1

(12) United States Patent
Conn

(10) Patent No.: US 6,257,850 B1
(45) **Date of Patent: *Jul. 10, 2001**

(54) PISTON AND SEALS FOR A RECIPROCATING PUMP

(76) Inventor: Kenneth S. Conn, 29 Lang Crescent SW., Medicine Hat, Alberta (CA), T1A 4P6

( * ) Notice: Subject to any disclaimer, the term of this patent is extended or adjusted under 35 U.S.C. 154(b) by 0 days.

This patent is subject to a terminal disclaimer.

(21) Appl. No.: 09/558,842

(22) Filed: Apr. 27, 2000

Related U.S. Application Data

(63) Continuation-in-part of application No. 09/045,049, filed on Mar. 20, 1998, now Pat. No. 6,099,274.
(60) Provisional application No. 60/041,028, filed on Mar. 21, 1997.

(51) Int. Cl.[7] ..... F04B 39/10; F04B 53/12
(52) U.S. Cl. ..... 417/547; 417/388; 166/369
(58) Field of Search ..... 417/547, 554, 417/444, 388, 469; 166/369

(56) References Cited

U.S. PATENT DOCUMENTS

| | | | | |
|---|---|---|---|---|
| 3,697,194 | | 10/1972 | Holmes | 417/54 |
| 3,773,441 | * | 11/1973 | Schertz | 417/554 |
| 4,087,212 | * | 5/1978 | Holder | 417/444 |
| 4,190,113 | | 2/1980 | Harrison | 166/311 |
| 4,493,383 | | 1/1985 | Williams et al. | 175/234 |
| 4,611,974 | * | 9/1986 | Holland | 417/388 |
| 4,661,052 | | 4/1987 | Ruhle | 417/552 |
| 4,711,299 | | 12/1987 | Caldwell et al. | 166/105.1 |
| 4,762,474 | * | 8/1988 | Dartnall | 417/469 |
| 4,773,834 | | 9/1988 | Saruwatari | 418/48 |
| 4,949,758 | | 8/1990 | Bear | 138/177 |
| 5,040,608 | * | 8/1991 | Doan | 166/369 |
| 5,088,745 | | 2/1992 | Peppiatt et al. | 277/58 |
| 5,095,976 | | 3/1992 | Appleton | 166/105.1 |
| 6,099,274 | * | 8/2000 | Conn | 417/547 |

FOREIGN PATENT DOCUMENTS

| | | |
|---|---|---|
| 701761 | 1/1965 | (CA) . |
| 2016311 | 10/1994 | (CA) . |
| 1334733 | 3/1995 | (CA) . |

OTHER PUBLICATIONS

Brochure–"Positive Seal Sand Pump" Quinn Pump Division, Quinn's Oilfield Supply Ltd., P.O. Box 846, Red Deer Alberta, T4N 5H2, Canada; (403) 347–1128.
Brochure–"Positive Seal Sand Plunger", Quinn Pump Division, Quinn's Oilfield Supply Ltd., P.O. Box 846, Red Deer Alberta, T4N 5H2, Canada; (403) 347–1128.

* cited by examiner

*Primary Examiner*—Teresa Walberg
*Assistant Examiner*—Leonid Fastovsky
(74) *Attorney, Agent, or Firm*—Millen, White, Zelano & Branigan, P.C.

(57) ABSTRACT

A piston and seals for a reciprocating pump improve pumping of subterranean fluids containing fine solids to surface. The pump comprises a pump barrel and piston. The piston is suspended from a reciprocating rod string or from reciprocating production tubing. The barrel is held stationary relative to the casing of a well. A standing valve is located at the bottom of the barrel. The piston and travelling valve are located at the bottom of the piston rod for minimizing the dead-space between standing and travelling valves. Upper and lower stacks of hydraulic piston seal rings are positioned on the piston above and below the travelling valve for minimizing piston height. Each seal has radially flared lips at its leading edge. The piston has spaced grooves formed therein, corresponding to the seal ring flared lips. At least the lower seal stack is axially movable so that the flared lips alternate between being compressed against the piston during the pumping stroke and being engaged with their respective grooves on the return stroke thereby relaxing the lips, reducing seal wear and releasing pressure trapped between the upper and lower seals. A barrel wiper at the lower seal ensures sand is excluded from the lower seal. Large bore flow passages are provided in the piston rod and valves.

14 Claims, 13 Drawing Sheets

9
9
49
31b
49
41
27
27
27
28
27
27
27
44
22
8
8
20
23
44
27
27
27
28
27
27
27
41
42
31
43

8
20
23
44
28
27
27
27
41
42, 43
31

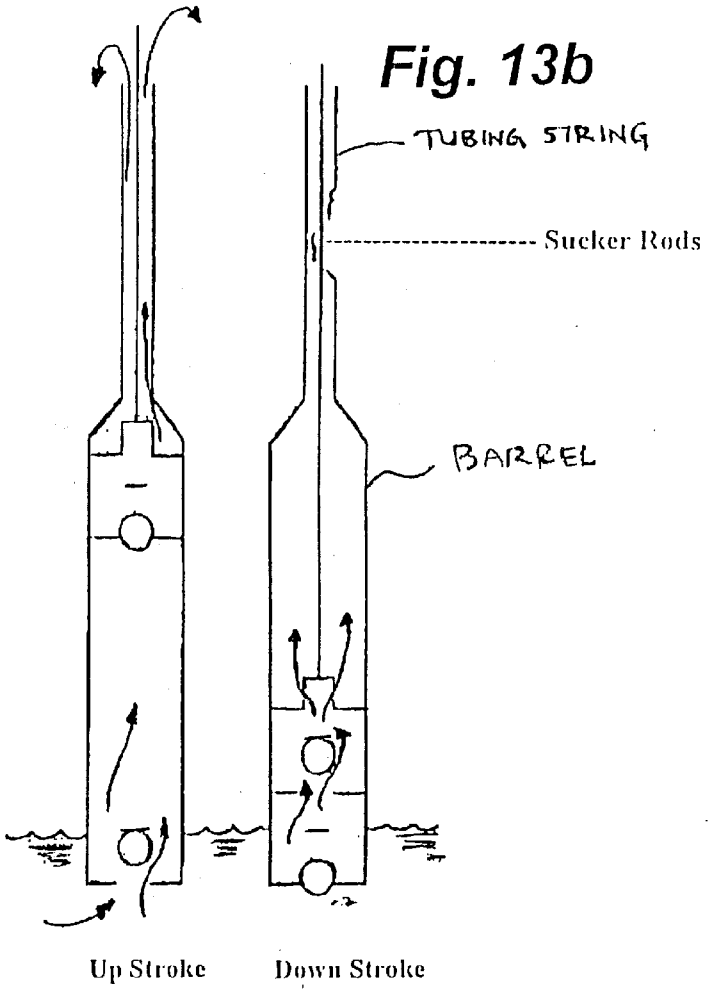
Sucker Rod Pump
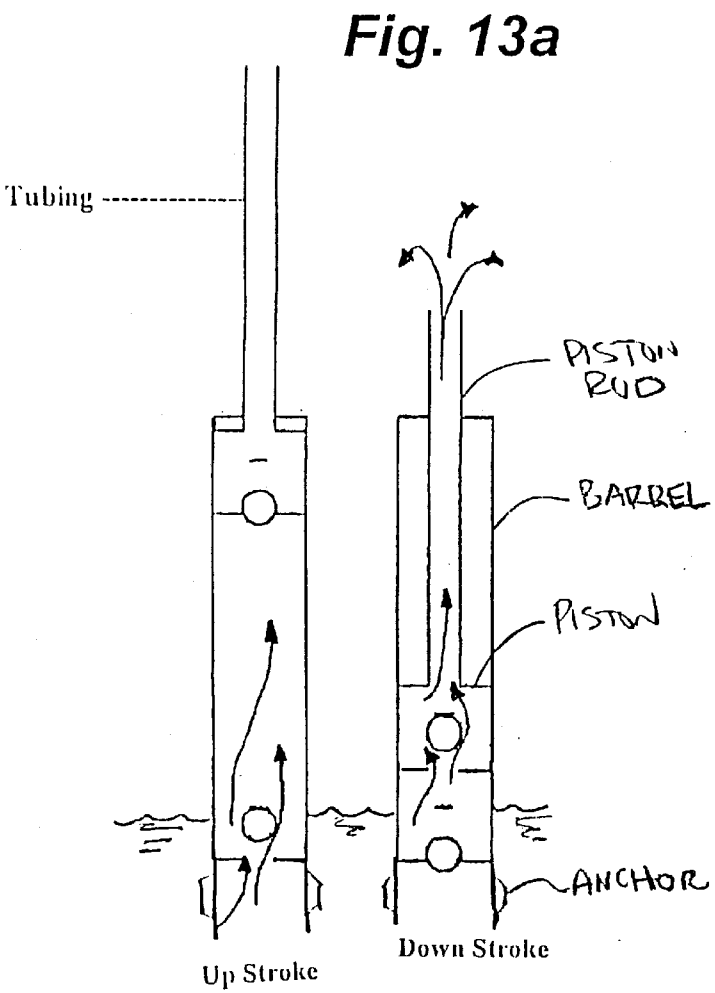
Pump to Surface Tool

PISTON AND SEALS FOR A RECIPROCATING PUMP

CROSS REFERENCE TO RELATED APPLICATION

This application is a continuation-in-part of U.S. patent application Ser. No. 09/045,049 on Mar. 20, 1998 now U.S. Pat. No. 6,099,274 and U.S. Provisional application Ser. No. 60/041,028, filed Mar. 21, 1997.

FIELD OF THE INVENTION

The invention relates to oil wells which produce a large fraction of sand and reciprocating pistons, seals and pumps capable of pumping such sand and oil on a continuous basis.

BACKGROUND OF THE INVENTION

In Southern Alberta, Canada, heavy oil is sometimes recovered from unconsolidated sandstone formations using a technique called cold production. The operator of the well aggressively perforates the well and purposefully produces formation sand along with the heavy oil. This technique pulls sand from the formation, increasing oil mobility and formation permeability for improving the flow of viscous oil to the well. Typically sand production is high upon well completion and for a period thereafter. Often a sump is used, located below the perforations for collecting the first inrush of sand. Conventional pumps such as progressive cavity pumps (PCP) or reciprocating rod pumps can be used with sand concentration less that about 20%. PCP's are more tolerant of sand than are reciprocating pumps. However, excessive sand concentrations still persist in some wells. The sump and well can sand-in and sand slugs can pump umps and halt production until an expensive and time-consuming workover clears the sand. Usually, by that time PCP failure has occurred. If a low cost reciprocating pump jack or rotary top drive is used to operate the pump, an expensive service rig must be called in to pull the pump or flush the PCP. Even more costly is to maintain a service rig at the well.

For removing excessive sand and for emptying a sump, prior art techniques include using a reciprocating barrel pump with a lower, sand-collecting tailpiece. This process is termed "bailing". The pump is located above the tailpiece. The pump draws solids and liquid into the tailpiece. Solids settle and liquid continues upwardly to spill back into the annular space between the pump barrel and the wellbore. Solids collect until the tailpiece is full and it is pulled out of the well.

In U.S. Pat. No. 4,711,299 to Caldwell, a reciprocating barrel pump is applied to a well with solids, and more specifically a well having undesirable liquids which need to be pumped out of the well. The pump barrel is suspended from a tubing string. An upper check valve is fitted at the top of the barrel. A stationary piston having a hollow piston rod hangs from and below the barrel. A tailpiece is once again provided which hangs from the piston rod. A lower check valve is fitted at the bottom of the piston rod, adjacent or within the tailpiece. When the barrel reciprocates, sand and liquid is drawn into the tailpiece. The entrance to the piston rod is purposefully narrow to cause high velocity liquid flow. Solids are not intended to pass above the lower check valve. In some implementations a screen rejects solids. Liquid continues up through the piston rod and out of the well as required.

Bailers do not pump sand to the surface and must be pulled from the well to remove sand and return the conventional pump to the well.

Others, such as Site Oil Tools and Arrow Oil Tools have converted conventional bailers to systems which pump sand and liquid to the surface by the addition of an anchor. Conversion from liquid only bailer to pumps handling sand as well introduces several operational difficulties. The travelling valve is located at the top of the piston rod which means they can be in the order of 12 feet from the standing valve. Suction created by these arrangements is poor, resulting in loss of pumping. The small bore through the piston rod causes high pressures in the barrel when the piston and piston rod stroke downwardly. At these pressures, sand separates from the oil and pack up in the barrel, and also form wads or balls of sand which can bridge the production tubing or block elbows and valves at the surface. Further, the sand causes significant wear on the moving components of the pump.

Typically, bailers and bailer conversions use "V"-cup packing, such as that use in wellhead rod seals). The packing-type seals are virtually incapable of sustained use when exposed to sand.

Production pumps, which utilize reciprocating rods, seriously impede the flow path to the surface particularly when the rods alternately move contrary to the desired flow of sand-laden oil, cause fall out of sand, and suffer delayed rod fall. Further, the rod pumps and known reciprocating pumps generally use pistons having elastomeric seals snugly supported in individual piston grooves, subject to being rendered ineffective with sand. As shown in a prior art pump in FIG. 1, the piston can be 2–4 feet long, the travelling valve and standing valves are widely spaced and no means are provided for excluding sand.

Sands from the above-described wells are very fine and tend to pack up in the individual piston grooves and render the seals ineffectual. The sand may be likened to a lapping compound, causing high wear and ultimately resulting in barrel failure.

The problems of sanding in heavy oil wells is discussed in a 1995 paper presented at a Heavy Oil Symposium in Calgary, Alberta, "Practical Requirements for Sand Production Implementation in Heavy Oil Applications", by Dusseault, M. B. et al., publication SPE 30259. The authors identify quick removal of bailers and the resulting suction as one of the causes of re-sanding. The authors further suggest improvements such as washing techniques, jet pump to surface techniques, and slow withdrawal of bailers with fluid replacement.

In this paper, the aforementioned authors acknowledge the superiority of PCP over reciprocation pumps, yet describe PCP failures and reiterate the need for effective sand removal and sand-tolerant pumps.

There is thus an expressed need for a pump which replaces the known bailer or bailer conversions, rod pumps and progressive cavity pumps for pumping liquids to the surface from wells having liquids associated with fine solids, particularly cold production heavy oil wells.

SUMMARY OF THE INVENTION

A sand-tolerant seal assembly is provided for use with a piston and barrel pump arrangement. In contradistinction with the known art of providing one of more continuous-sealing seal rings in individual grooves, applicant provides a stack of one or more seal rings having leading edge flares which are fitted to the piston and which move between a pair of retaining rings. The rings are fitted to a cylindrical portion of the piston which is periodically formed with grooves, the groove matching in number and profile of the seal ring flares. Between the retaining rings, the stack has a finite axial movement between positive and weakly sealing positions. Upon a pumping stroke, the stack of rings move, compressing the flares on the piston's cylindrical portion. On a return stroke, the stack of rings move, allowing the flares to engage the groove, decompressing the flares.

Decompression for 50% of the stroke reduces seal wear and can release trapped pressure between opposing seal assemblies on a double acting piston. More preferably the released pressure is directed from the stack of ring seals, through ports, and into bore of the piston.

When applied to downhole pumps, a reciprocating pump is provided for production (used with a rod string) or for pumping to surface (reciprocating tubing). The double acting piston of a downhole pump is fitted with both upper and lower seal assemblies. A bore wiper is provided for excluding sand from the lower seal area. Preferably the travelling valve forms part of the piston with upper and lower seals positioned at either end. The positioning of the seals aids in reducing the dead-space and minimizing piston length.

The downhole pump comprises a pump barrel which located and is held stationary in the casing of cold production wells, a piston, (piston rod for pump to surface arrangements) and standing and travelling valves. The pump is capable not only of bailing but is also used in the steady-state production of oil to the surface. For a production pump, this dual role is achieved through a combination of:

providing large bore flow passages in the piston rod and valves and thus minimizing the separation of sand from oil and packing of sand at obstructions. This is preferably achieved by using a high strength material for the piston rod so that the wall thickness can be minimized and the bore diameter maximized;

minimizing of the dead-space between standing and travelling valves for improving pump efficiency and minimizing gas-locking by locating the travelling valve at the base of the piston rod and intermediate the upper and lower seals; and a sand-tolerant seal assembly as described above.

In the case of reciprocating tubing string pumps, one also provides a complementary piston rod and pump barrel for enabling rotary actuation of the anchor, preferably either using a non-circular high strength piston rod and complementary barrel bushing or using a tang and recess, dog clutch like-arrangement.

BRIEF DESCRIPTION OF THE DRAWINGS

FIGS. 13*a* and 13*b* are schematic views of the operation of a pump to surface pump and a production rod pump respectively.

DETAILED DESCRIPTION OF THE PREFERRED EMBODIMENT

Figures 1A, 1B:
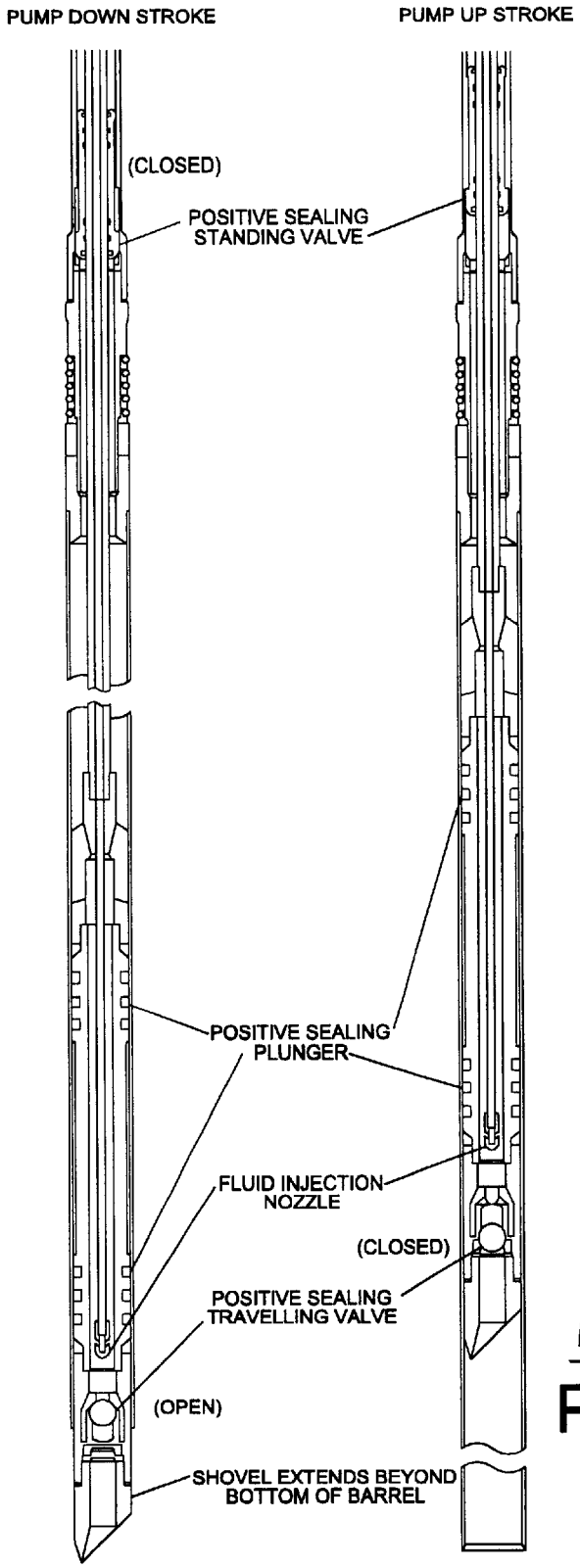
Fig. 1a Prior Art
Fig. 1b Prior Art
FIG. 1*a* is cross-sectional view of a prior art reciprocating pump completing a downstroke.
FIG. 1*b* is cross-sectional view of the prior art pump of FIG. 1*a* completing an upstroke.
Figure 2A:
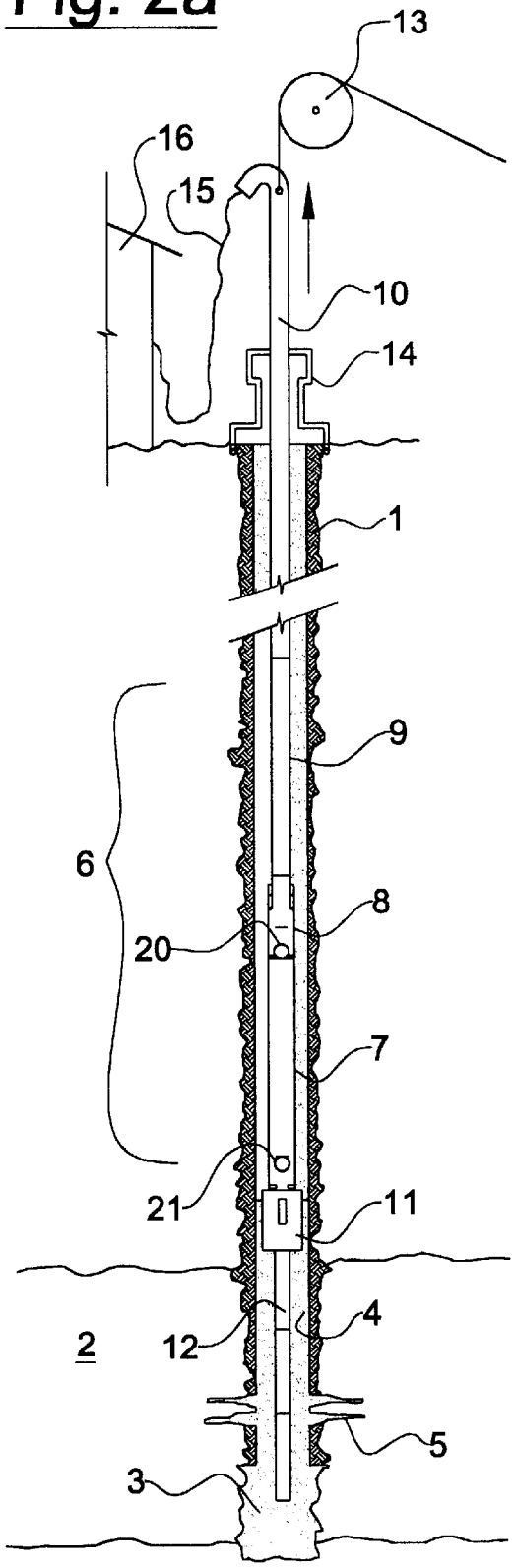
FIG. 2*a* is cross-sectional view of a well completed into a sand and oil producing formation having a reciprocating pump to surface pump of the present invention installed therein. The pump is completing an upstroke.
Figure 2B:
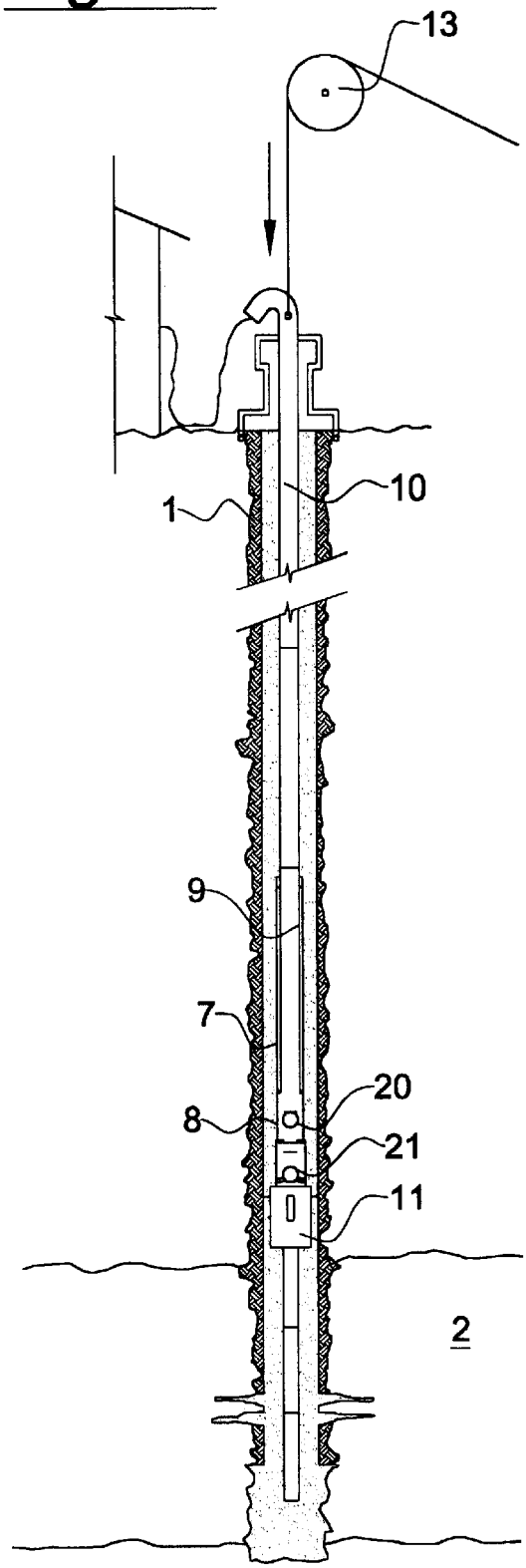
FIG. 2*b* is cross-sectional view of the well and pump to surface pump of FIG. 2*a* wherein the pump is on a downstroke.

Having reference to FIGS. 2*a* and 2*b*, a well 1 is completed into an unconsolidated sandstone formation 2 bearing heavy oil. The well is over-drilled to form a cellar or sump 3. The well is cased 4 and perforated 5. A novel reciprocating pump 6 is installed. In FIG. 2*a* the pump shows an upstroke for pumping to surface and drawing sand and oil into the pump. In FIG. 2*b* the pump is shown at the bottom of the downstroke for cycling just prior to lifting the next charge of sand and oil.

Figure 3:
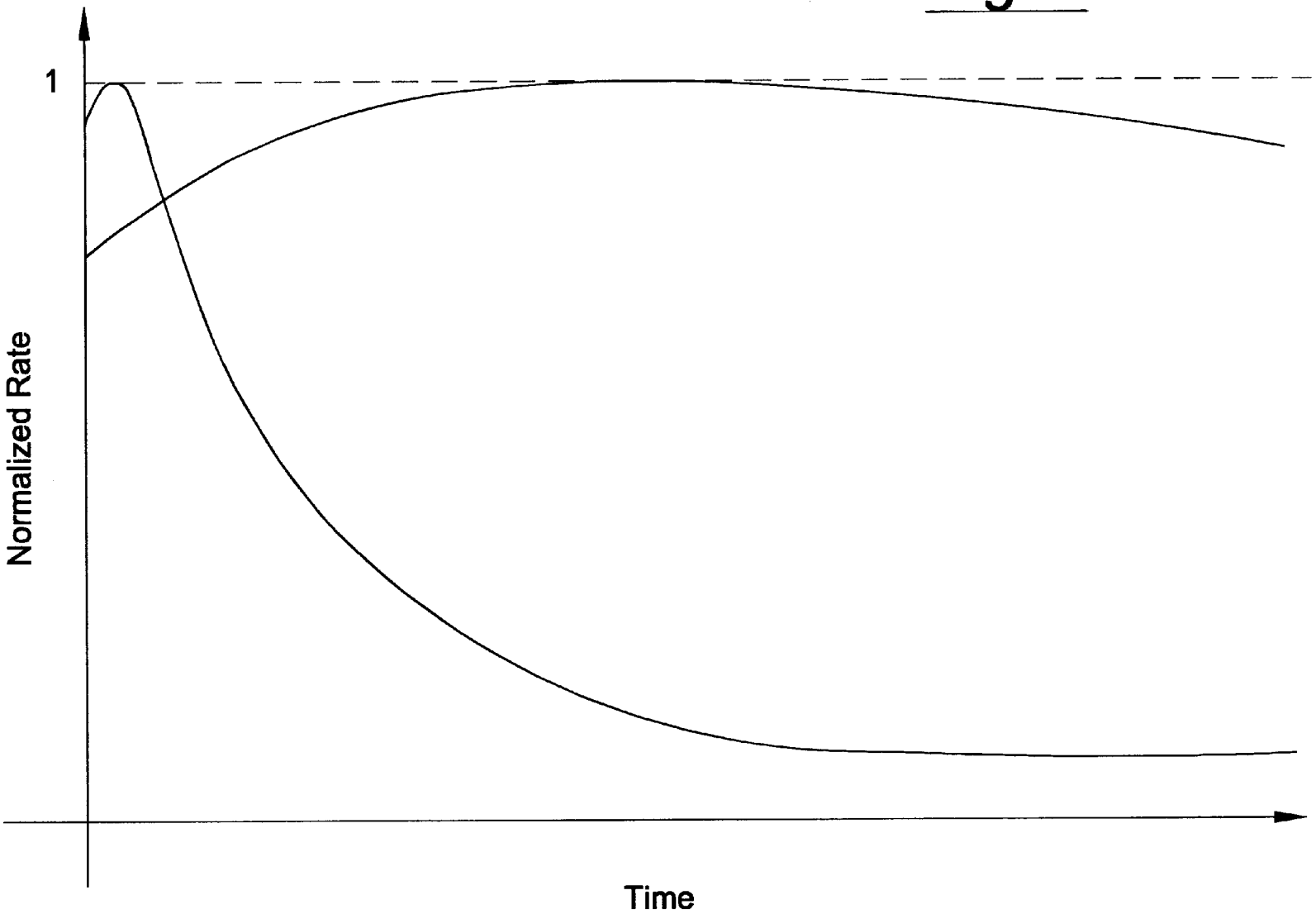
FIG. 3 is a chart of the relative production of sand and fluid from a cold production heavy oil well such as that shown in FIG. 2*a;*

When operated, as shown in FIG. 3, the pump is expected to initially produce a significant amount of sand (dotted line) at a high sand ratios of about 15 to 40% sand-to-oil. This can also occur after a workover. Over several weeks of steady state operation, the sand ratio typically drops to about 10%. The gross fluid production (solid line) initially rises as the sand ratio drops and then slowly diminishes.

The pump 6 (FIGS. 2*a*,2*b*) comprises a barrel 7, a piston 8 and a piston rod 9. The piston rod 9 is suspended in the well 1 from production tubing 10. A tension anchor 11 is affixed to the bottom of the barrel 7 for securing the barrel to the casing 4. Additional tubing or a tailpiece 12 extends downwards from the pump barrel 7 and into sump 3, below the perforations 5. The tailpiece 12 extends the pump's suction from the barrel 7, through the anchor 11 and down to the bottom of the tailpiece 12.

Surface equipment 13 causes the production tubing 10 to reciprocate or stroke up and down. A wellhead 14 contains packing for sealing the well 1 to the reciprocating tubing 10. The pump 6 pumps fluid and sand from the sump 3, up the production tubing 10 to the surface, through a hose 15 and into a tank 16.

The pump barrel 7 is stationary, as affixed to the casing 4 by tension anchor 11. The piston rod 9 is axially movable within the barrel 7. The piston 8 is located at the bottom of the piston rod 9. A one way ball or travelling valve 20 is also located at the bottom of the piston rod 9. A one way ball or standing valve 21 is located at the bottom of the barrel 7. In the barrel 7, between the standing valve 21 and the travelling valve 20 is formed a fluid chamber 7*b*. Both valves 20,21 utilize Titanium 2¼" balls and oversized 2⅛" seats modified from 2" stock valves available from Harbison-Fischer Canada Ltd, Calgary, Alberta, Canada.

Figure 7A:
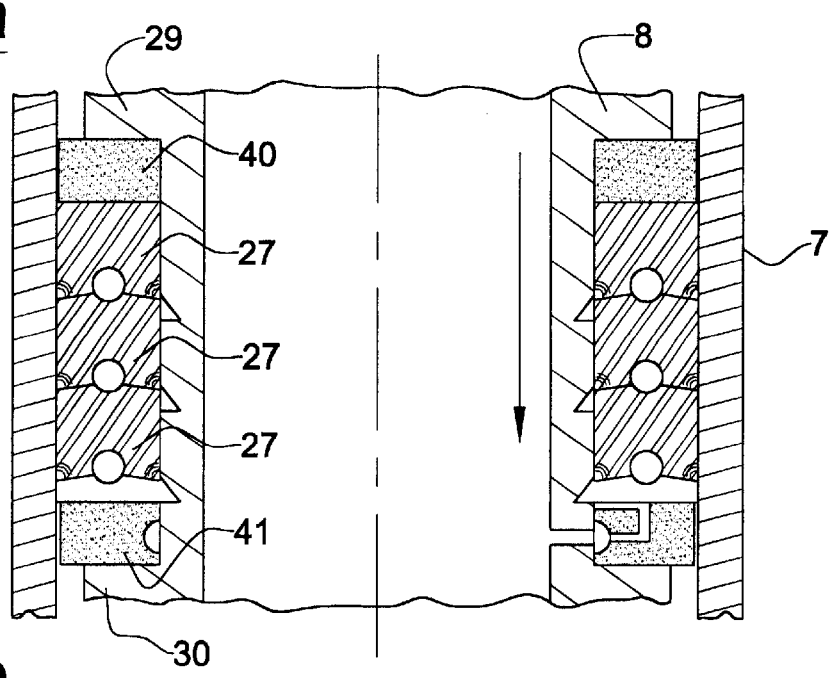
FIG. 7*a* is a simplified diagrammatic representation of a cross-section of the lower piston seal which demonstrates the pump's downstroke and the positive sealing achieved by the seal rings against both the piston and the barrel.
Figure 8A:
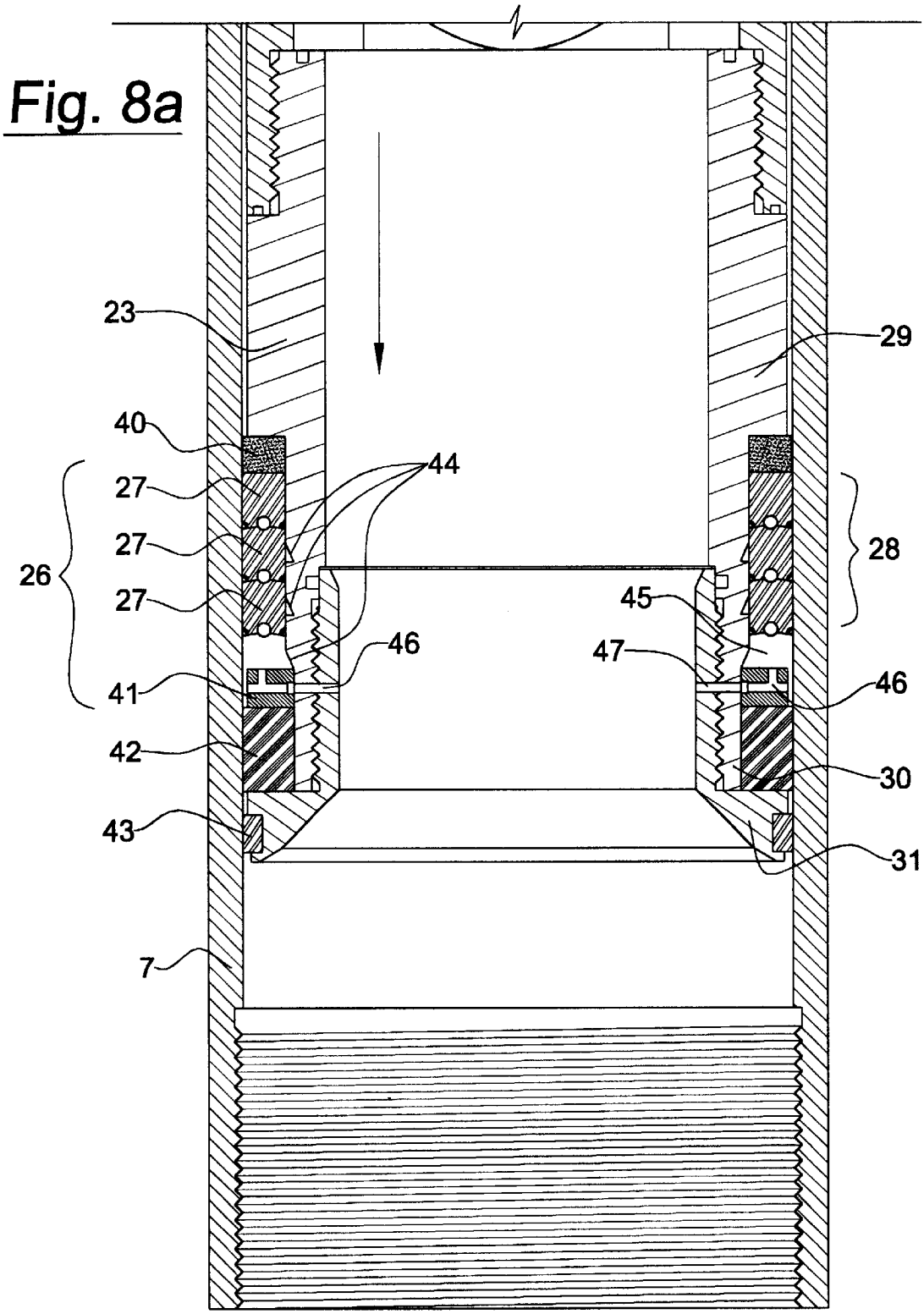
FIG. 8*a* is a cross-sectional view of a preferred embodiment of the pump corresponding to FIG. 7*a;*
Figure 8B:
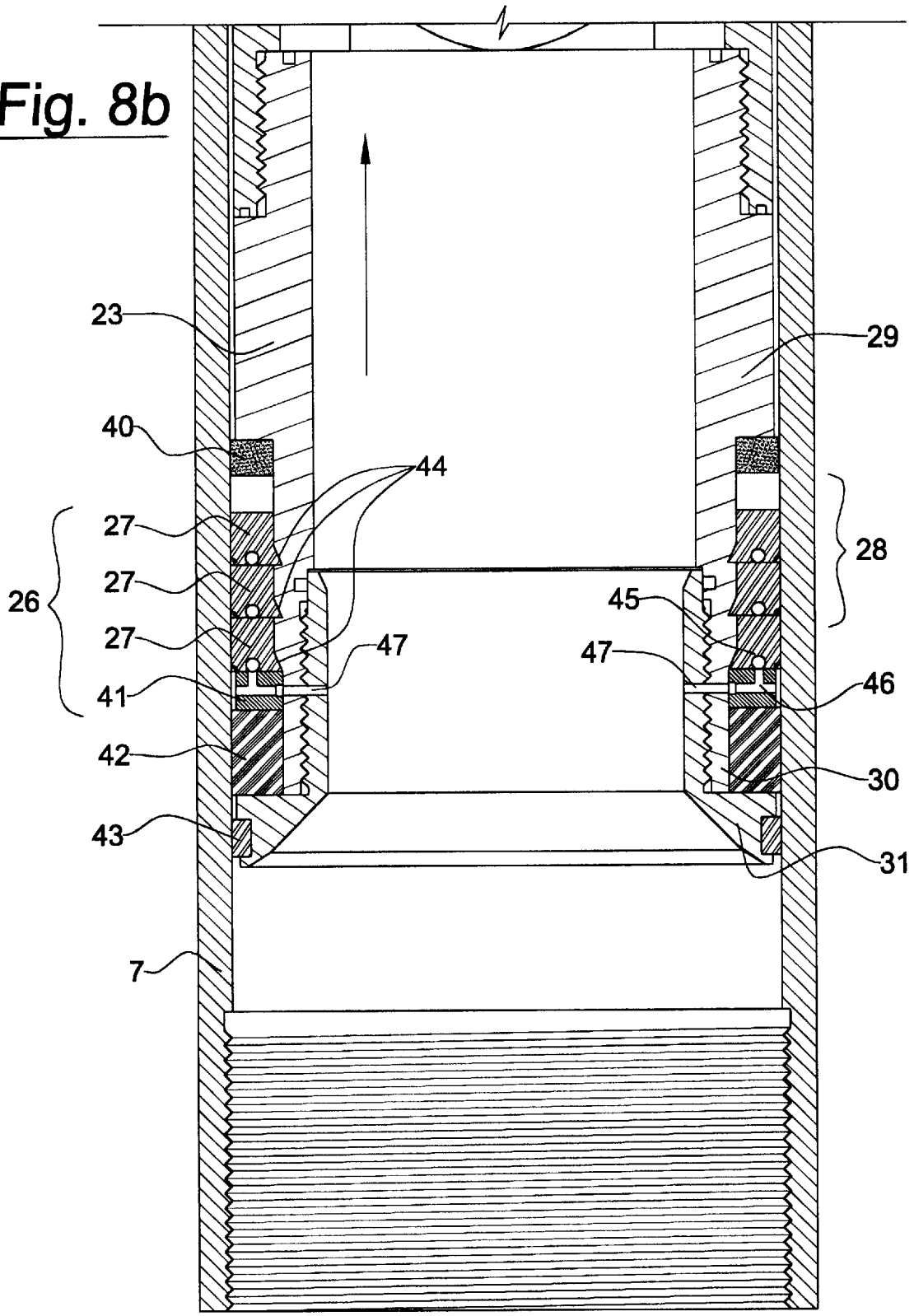
FIG. 8*b* is a cross-sectional view of a preferred embodiment of the pump corresponding to FIG. 8*b;*
Figure 9:
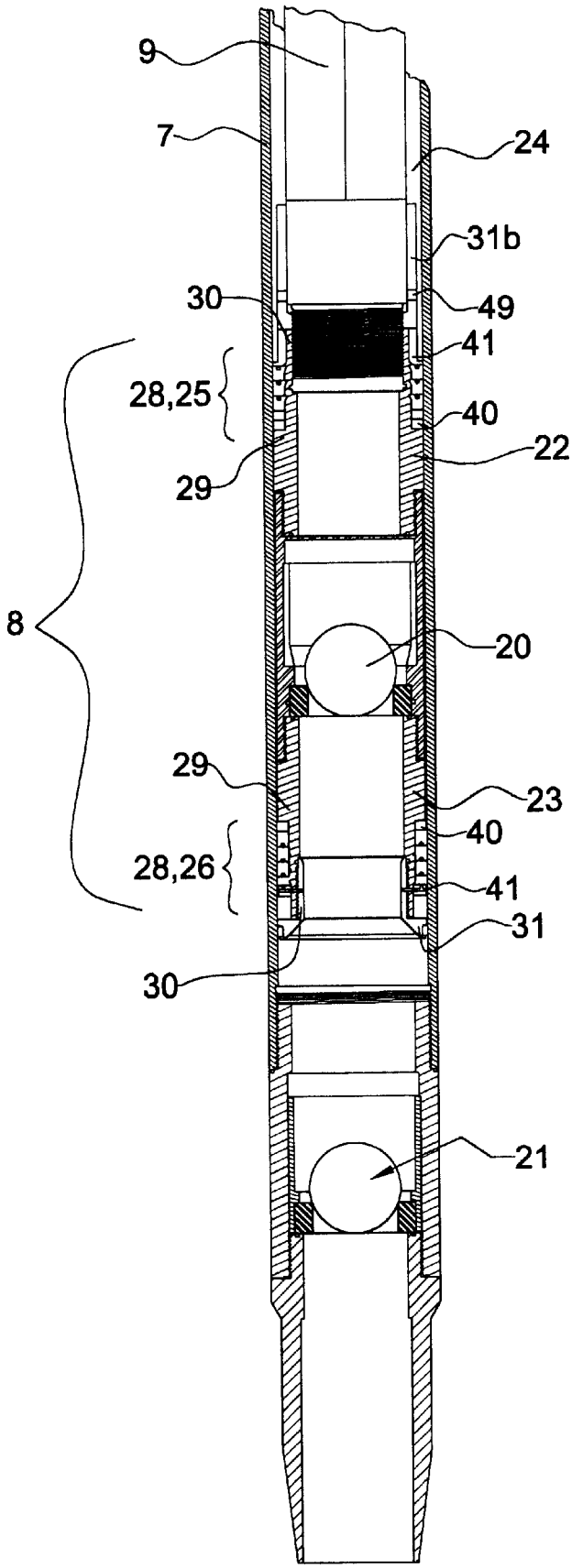
FIG. 9 is a cross-sectional view of the pump showing the piston near the bottom of its downstroke for illustrating the travelling valve, the standing valve and the piston.

Having reference to FIGS. 6–10*b*, the longevity of the pump operation is enhanced significantly by a novel piston and sealing arrangement. As shown in FIG. 9, the piston 8 is an assembly comprising the travelling valve 20, an upper cylindrical end or seal sleeve 22 and a lower cylindrical end or seal sleeve 23. The sleeves 22,23 are substantially identical. An annulus 24 is formed between each sleeve 22,23 and the barrel 7. Seals are mounted on the sleeves 22,23, an upper seal 25 and a lower seal 26 respectively. Each seal 25,26 comprises a plurality of seal rings 27 which are installed as stacks 28 on the sleeves 22,23. The sleeves 22,23 have a base 29 and a tip 30. The base 29 of each sleeve 22,23 is connected to the respective top and bottom of the travelling valve 20. Retainers 31*b*, 31 are secured to each sleeve's tip 30 to secure the stacks 28 on their respective sleeves 22,23. Each seal ring 27 is a hydraulic seal such as those available as "Polypak" (trademark) model # 461525003250-375 from Parker Seal Group of Lexington, Ky., USA.

Each seal ring 27 has a leading face 32 (FIG. 6) which is oriented to maintain a pressure differential in one direction. The leading face 32 of each seal ring 27 in the upper seal 25 faces the surface and is effective to create suction in the barrel 7 as the piston rod 9 and piston 8 stroke upwardly. The leading face 32 of each seal ring 27 in the lower seal 26 faces the standing valve 21 and is effective to hold pressure in the barrel 7 as the piston rod 9 falls and forces fluid from the barrel into piston rod 9 and the production tubing 10.

Figure 6:
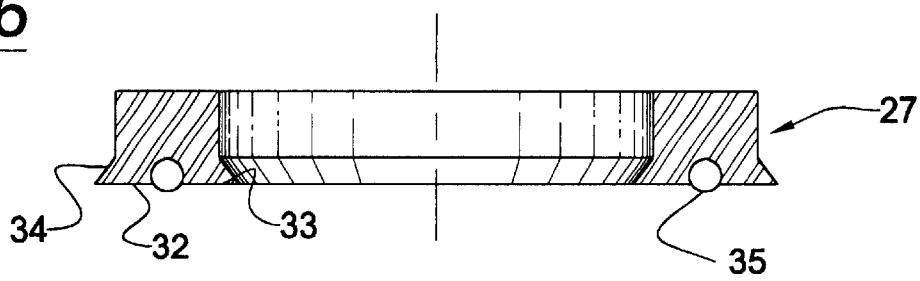
FIG. 6 is cross-sectional view of one of a plurality of hydraulic seal rings used in the pump to surface pump.

Each seal ring 27 and stack 28 is located in the annulus 24. The cross-section of the seal ring 27 is substantially rectangular. As shown in FIG. 6, the leading face 32 is radially flared, having an inner radially-extending lip 33 for engaging the piston 8 and an outer radially-extending lip 34 for engaging the barrel 7. The annulus 24 at the sleeves 22,23 is sized for the width of the seal ring's rectangular cross-section. Accordingly, the flared lips 33,34 are normally compressed into a width of the rectangle cross-section for creating an effective seal against both the piston 8 and the barrel 7 (this lip compression is conceptually depicted as small arcuate marks in each seal ring 27 on FIGS. 7*a* and 7*b*.)

The hydraulic seal ring 27 depicted in FIG. 6 has an additional O-ring 35 located midpoint of the ring's cross-section and along the leading edge 32. The additional radial area formed by the O-ring cavity aids in hydraulically driving the lips radially into stronger engagement with their respective sealing surfaces. Not all seal ring manufacturers utilize the additional O-ring concept but most provide the inward and outward lips 33,34.

Having reference to FIGS. 8*a*,8*b*,9 and FIGS. 10*a*–10*c*, listed consecutively from the base 29 to the tip 30 of the lower sleeve 23 are: a first retaining ring 40, the seal stack 28, a second retaining ring 41, a rider ring 42, and a wiper ring 43. The seal stack 28 is sandwiched between the retaining rings 40,41. Correspondingly, listed from base to tip, the upper sleeve 22 (FIG. 9) has a first retaining ring 40, the seal stack 28, and a second retaining ring 41. The seal stack 28 is sandwiched between the retaining rings 40,41.

The first retainer rings 40 are formed of brass and the second retaining rings 41 are formed of steel. The retainer rings 40,41 are spaced from the barrel 7 so as to avoid contact with the barrel 7. The lower seal 26 is subjected to more sand and accordingly includes both a rider ring 42 formed of Teflon and, more importantly, the wiper 43, formed of Teflon or cast iron. Wiper 43 is a split spring ring with an uncompressed diameter greater than the bore of the barrel 7 which is compressed to fit in the barrel 7.

Figures 10A, 10B:
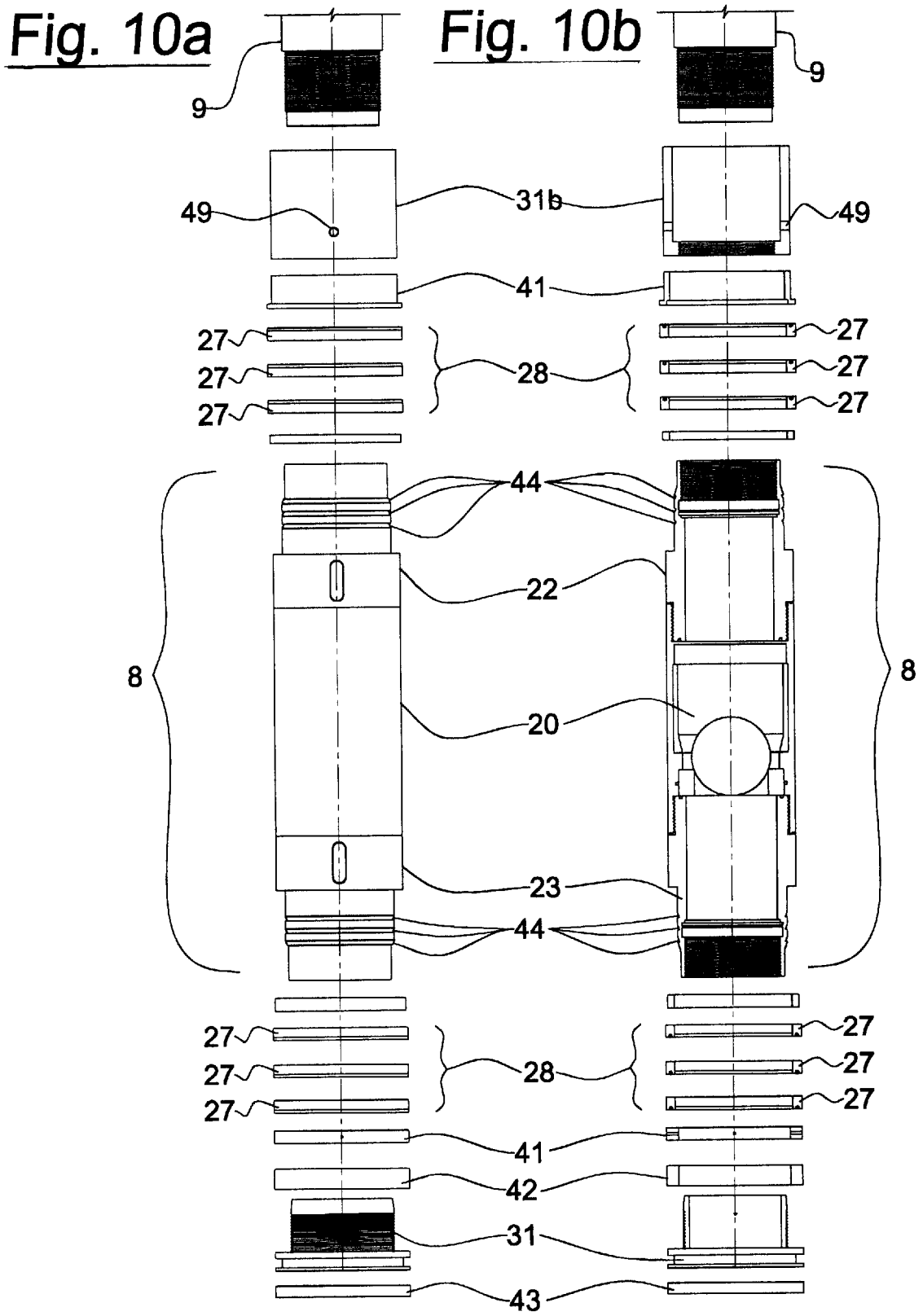
FIG. 10*a* is an exploded side view of the piston, depicting the seals, retaining rings, riders and wipers.
FIG. 10*b* is an exploded cross-sectional view of the piston, depicting the seals, retaining rings, riders and wipers.
Figure 10C:
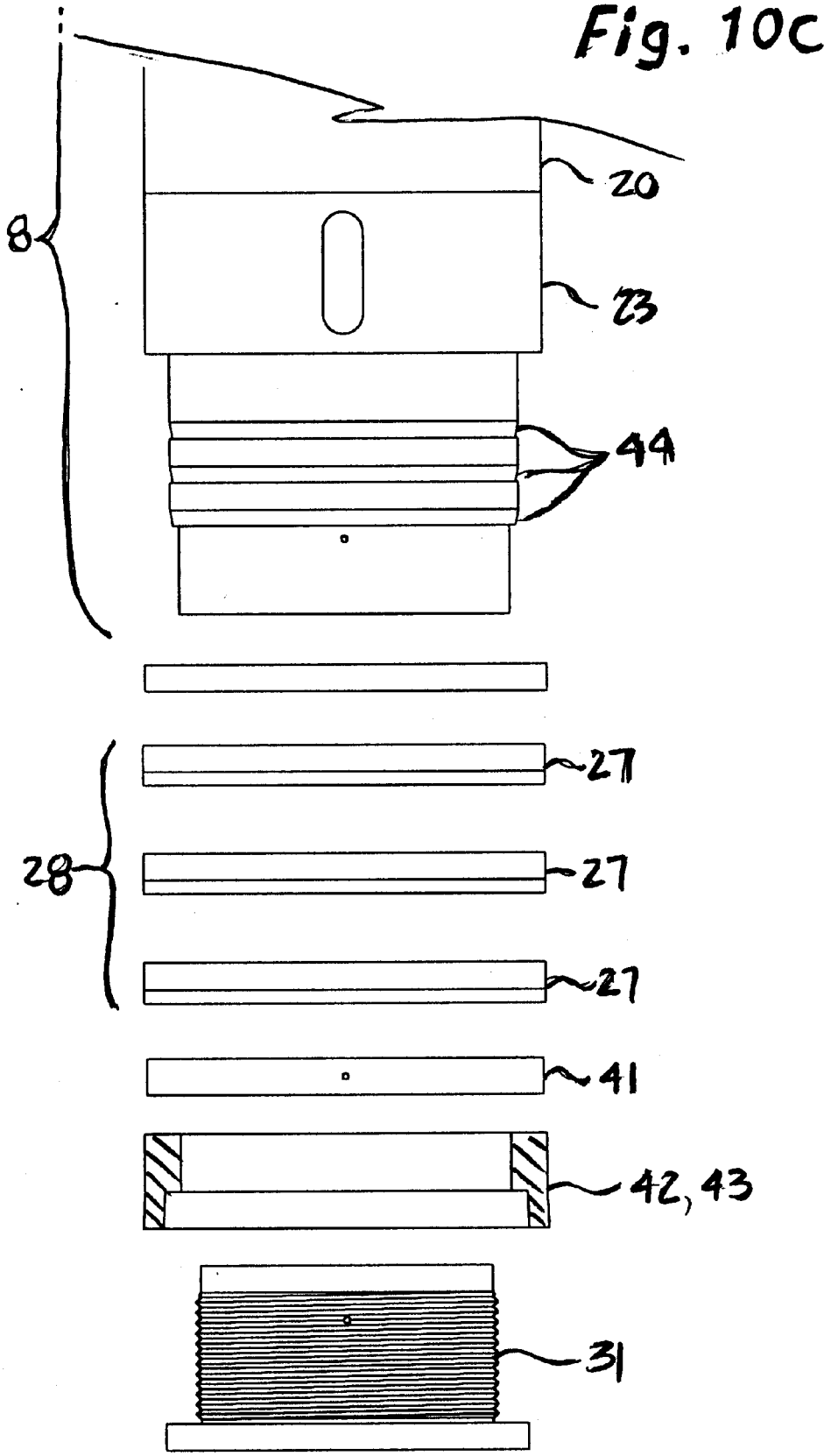
FIG. 10*c* is an exploded side view of the lower end of the piston, depicting the seals, retaining rings, and an optional large leading wiper.

Optionally, as shown in FIG. 10*c*, the wiper 43 and rider ring 42 can be combined 42,43 (shown in cross-section) wherein a leading portion of the ring extends axially beyond the retainer 31 to be the first contact with the barrel to piston interface.

Each sleeve 22,23 is formed with circumferential grooves 44. The grooves 44 are spaced axially, the spacing being about the axial height of each seal ring 27. The profile of the grooves 44 is complementary to the inner lip 33 of the seal ring 27, i.e. triangular. The retainer rings 40,41 are spaced an axial distance equal to the seal stack 28 plus the height of one groove 44 and thus form a gap 45. Accordingly, the seal stack 28 will be axially movable on their respective sleeves 22,23 between two positions, delimited by the base retaining rings 40 and the tip retaining ring 41.

Figure 7B:
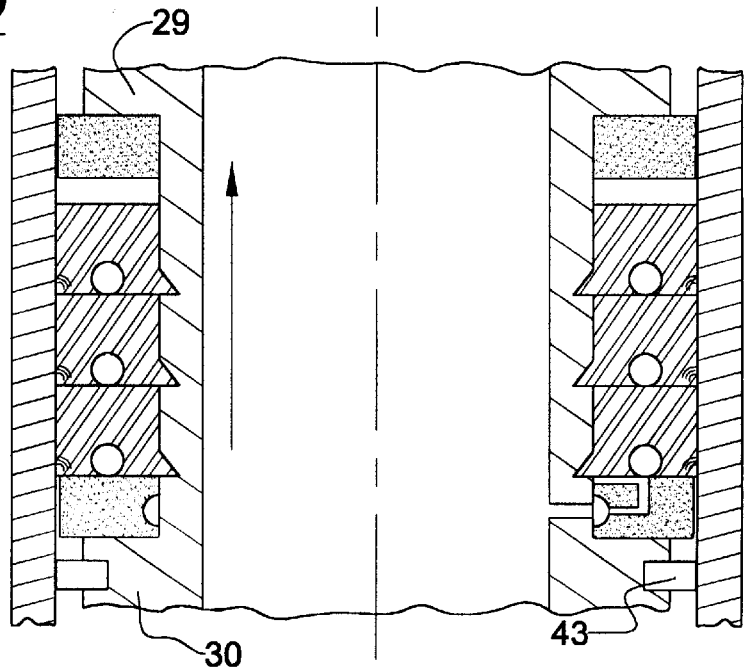
FIG. 7*b* is a simplified diagrammatic representation of the cross-section of the lower piston seal according to FIG. 7*a* which demonstrates the pump's upstroke wherein the seal rings shift axially until the seal rings inner lip engages the sleeve groove, weakening the seal against the piston and thereby avoiding a pressure trap between the upper and lower seals.

When each seal ring 27 moves axially on the sleeve 22,23, the inner lip 33 is compressed against the cylindrical portion of the sleeve proper (i.e. not adjacent a groove, in FIGS. 7*a* and 8*a*) and is decompressed as the inner lip 33 projects into a groove 44 (FIGS. 7*b* and 8*b*). Decompression of the lip 33 interferes with the normally good seal and enables release of pressure past the seal ring 27.

As the seal stack 28 moves between retaining rings 40,41, the inner lips 33 of each of the rings 27 simultaneously engage the grooves 44 (FIGS. 7*b*,8*b*) or alternately, all the inner lips 33 are compressed against the sleeve 22,23 proper (FIGS. 7*a*,8*a*). More particularly, the grooves 44 are axially offset towards the tip 30 of each sleeve 22,23 so that when the seal stack 28 is biased towards the base retaining ring 40, the flared portion 33,34 of the seal rings 27 engage the cylindrical portion of the sleeve 22,23 and form an effective seal. Correspondingly, when the seal stack 28 is biased towards the tip's retaining ring 41, the inner lip 33 engages the groove 44, lessening the sealing action of the seal rings 27.

In summary, seals 25,26 are provided at the leading and trailing end of the piston 8 to keep sand out of the metal-to-metal piston/barrel portions. The upper and lower seals 25,26 cooperate to alternately seal on their respective strokes while the opposing seal releases pressure build up between the seals. Additionally, leading the lower seal 26 is the wiper 43 for excluding the largest part of the sand fines from the piston area.

The steel retaining ring 41 of the lower seal 26 is formed with channels 46 to direct release pressure from the piston 8 and conduct it through ports 47 into the barrel 7 area. Optionally, the ports 47 can connect directly to the seal stack. During the downstroke, the ports 47 also assist in pressurizing the leading edge of stack of seal rings and driving them into the sealing position.

Having reference to FIGS. 9–10*b*, the steel retaining ring 41 of the upper seal 25 is held in place with a retainer 31*b*, threaded onto the piston rod 9. The retainer 31*b* is axially elongate to limit the upward stroke of the piston 8. This limit ensures the upper seal does not engage vent holes (not shown) usually located at the top of the barrel 7. Set screws 49 lock the retainer 31*b* to the piston rod 9.

The ports 47 are depicted as straight through to the bore of the piston rod 9. Optionally, by axially staggering the ports 47 through the piston 8 from the sleeve 23 through the retainer 31, the pressure release path is forced through one or more threads. Accordingly, should sand be present, it is unable to flow into the lower seal 28.

Figure 4A:
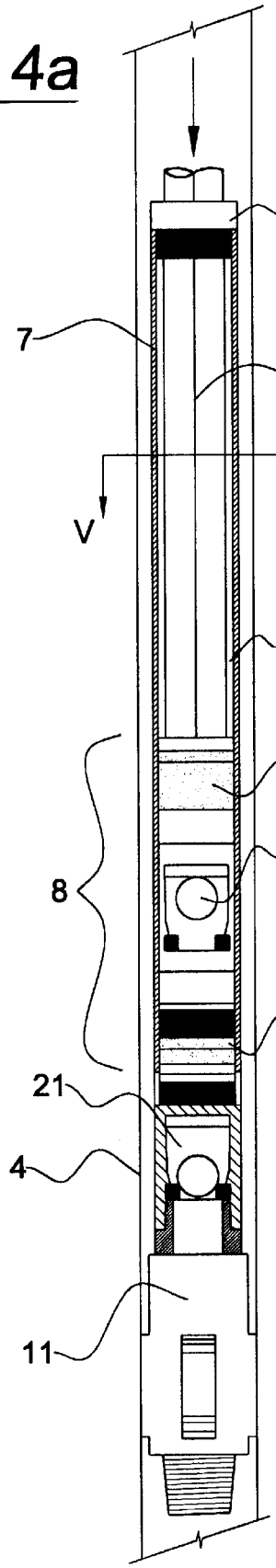
FIGS. 4*a* and 4*b* are cross-sectional views of the first embodiment of the pump to surface pump depicting the positioning of the travelling and standing valves and the polygonal piston rod and complementary bushing, depicting the pump near the bottom of the downstroke and near the top of the upstroke respectively.
Figure 4B:
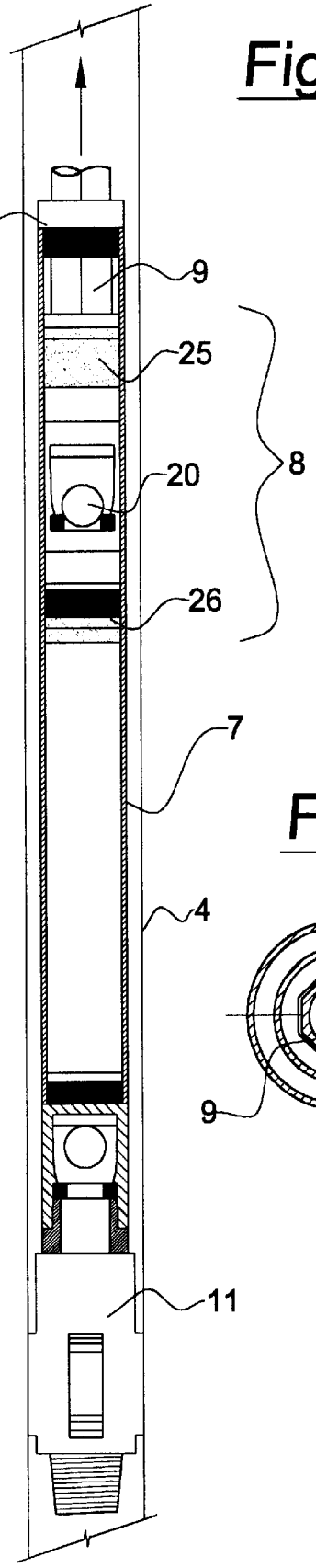
Figure 5:
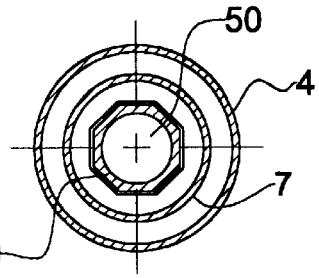
FIG. 5 is a cross-sectional view of the polygonal piston rod at line V—V of FIG. 4*a;*

In a first embodiment and having reference to a diagrammatic illustration of the pump in FIGS. 4*a*,4*b*, the piston rod 9 has a polygonal cross-section and has a longitudinally extending bore 50. The bore 50 has substantially the same internal diameter as that of the production tubing 10. A bushing 51, having a polygonal cross-section complementary to the piston rod 9, is affixed to the top of the barrel 7. The bushing 51 permits reciprocating action of the piston rod 9 but prevents relative rotation of the piston rod 9 and barrel 7. Rotation of the tubing 10 at the surface causes rotation of the piston rod 9. The rod 9 rotates the bushing 51 and barrel 7 for rotational activation of the tension anchor 11. Counter-clockwise tubing rotation can be used to set the anchor 11 and clockwise rotation to unset it.

The piston rod 9 must be sufficiently strong in tension to withstand the cyclic pumping loads and sufficiently strong in torsion to set and unset the tension anchor.

In conventional bailers, a polygonal piston rod is also known however, as described above, the materials of construction are ordinary and the longitudinal bore is small in cross-section, which results in sand drop out, packing of sand in the barrel and troublesome sand wads which bridge flow passages.

In the novel piston rod 9, the outer and internal diameters are maximized so as to minimally restrict the flow of sand-laden oil. To achieve this end, several obstacles had to be overcome. A large dimension polygonal piston rod 9 had to be prepared which has a minimal wall thickness. For 2⅞" production tubing having an internal diameter of 2.441", a piston rod can be provided having dimensions of 3" across the flats of a hexagonal rod, with an internal diameter of 2½. This rod fits within a 3¾ ID barrel as is commercially obtained from Quinn's Oilfield Supply Ltd., of Red Deer, Alberta.

The materials of construction of the polygonal piston rod are improved to 4140 heat treated and stress relieved steel bar stock. The 12 foot long bar stock must be bored with sufficient accuracy to minimize runout and avoid weakening of the rod. Preferably, trepanning is practiced for forming the bore, preferably in combination with careful quality control to ensure the rod's wall thickness does not become too thin locally.

The piston 8, is located at the bottom of the piston rod 9. Piston seals 25,26 extend across the annulus 24 to seal against the inside of the barrel 7. The piston 8 comprises a cylinder within which is located the travelling valve 20, sandwiched between upper and lower seals 25, 26. By positioning of the travelling valve 20 between the upper and lower seals, the minimum dead-space is achieved therebetween. The greater the dead-space, the less effective is the pumping suction capability and the greater is the opportunity for gas-locking.

In operation, when the piston 8 falls, the standing valve 21 closes and fluid and sand, in the fluid chamber 7*b*, flow through the travelling valve 20 and into the piston rod 9. When the piston 8 rises, the travelling valve 20 closes and the fluid and sand contained therein is lifted on its incremental lift to the surface. Also, as the piston 8 rises, more fluid and sand is drawn past the standing valve 21 and into the barrel 7 and fluid chamber 7*b*, for the next pumping cycle.

In summary, the novel pump 6 maximizes flow therethrough and thus retains the sand in a suspended state. Flow maximization is achieved in part by standing and travelling valves which have a minimum dead-space between them at the bottom of the piston rod's downstroke, and a high strength piston rod formed with minimum wall thickness and having an internal diameter substantially that of the production tubing diameter.

In a second embodiment (FIGS. 11*a*,11*b*), the polygonal piston rod 9 and bushing 52 is replaced with a dog clutch. Without the need for a polygonal exterior, the piston rod 9 is simply formed from a length of production tubing 10 (i.e. standard 2⅞" tubing having a 2.441" bore), modified to accept the piston 8. Without the polygonal rod and bushing, a rotational lock or dog clutch is provided.

Figures 11A, 11B:
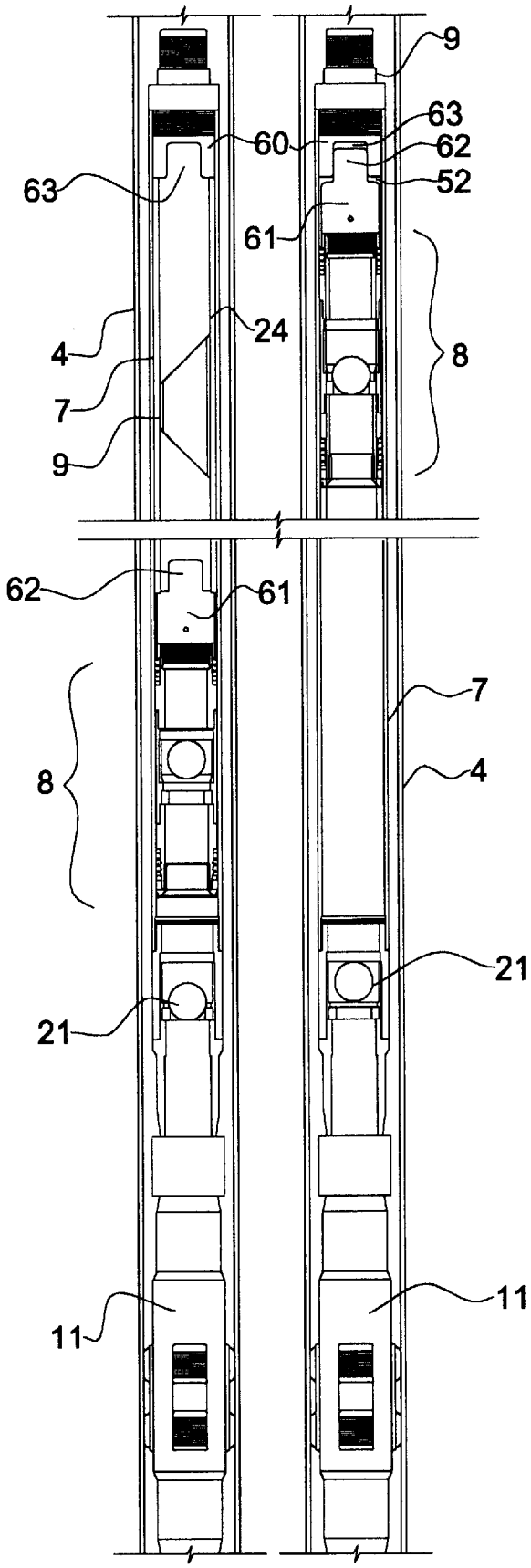
FIGS. 11*a* and 11*b* are cross-sectional views of the second embodiment of the pump to surface pump illustrating the tension anchor-actuating dog clutch, disengaged and engaged respectively.

Referring to FIGS. 11*a*,11*b*, the clutch comprises an upper clutch half 60, and a lower clutch half 61. The clutch halves 60, 61 are formed of cylindrical sleeves which reside within the annulus 24 formed between the piston rod 9 and the barrel 7. The clutch halves 60,61 meet axially and incorporate complementary axially extending and mating tangs 62 and recesses 63. More particularly, the lower clutch half 61 is integrated with the top of the piston, between the piston 8 and the piston rod 9 and comprises a cylindrical sleeve which extends axially and partly up the lower part of the outside of the piston rod 9. The lower clutch half 61 has an outer diameter smaller than the bore of the barrel 7. Two diametrically opposed tangs 62 extend axially upwardly from the lower clutch half 61.

The upper clutch half 60 is also located inside the barrel 7 and is integrated into the top of the barrel 7. The upper clutch half 60 comprises a sleeve extending axially and partly down from the top of the barrel 7. The inside diameter of the upper clutch half 60 is larger than the piston rod 9. Two diametrically opposed axially-upwardly extending recesses 63 are formed in the upper clutch half 60. The recesses 63 and tangs 62 are complementary and suited for axial mating or engagement. Accordingly, when the piston rod 9 is lifted, the tangs 62 of the lower clutch half 61 rise to the top of the pump barrel 7 and engage the recesses 63 of the upper clutch half 62. Once the engaged, rotation of the production tubing 10 at the surface causes the barrel 7 to rotate also, operating the tension anchor 11.

Having reference to FIG. 13*a* and FIG. 13*b* it is apparent that the operation of a pump to surface tool (FIG. 13*a*) requires anchoring of the barrel in the well and operation of a sucker rod pump (or often times called a production pump) does not. As shown in FIG. 13*a*, the barrel of a pump to surface pump is anchored in the well and fluids flow prom the piston, up the piston rod and up the reciprocating tubing string. In a rod pump, per FIG. 13*b*, the barrel is held by a stationary tubing string. A reciprocating string of rods stroke the piston and fluids flow up from the piston and up the tubing string. Accordingly, a production pump need not incorporate an anchor.

EXAMPLE I

Figure 12:
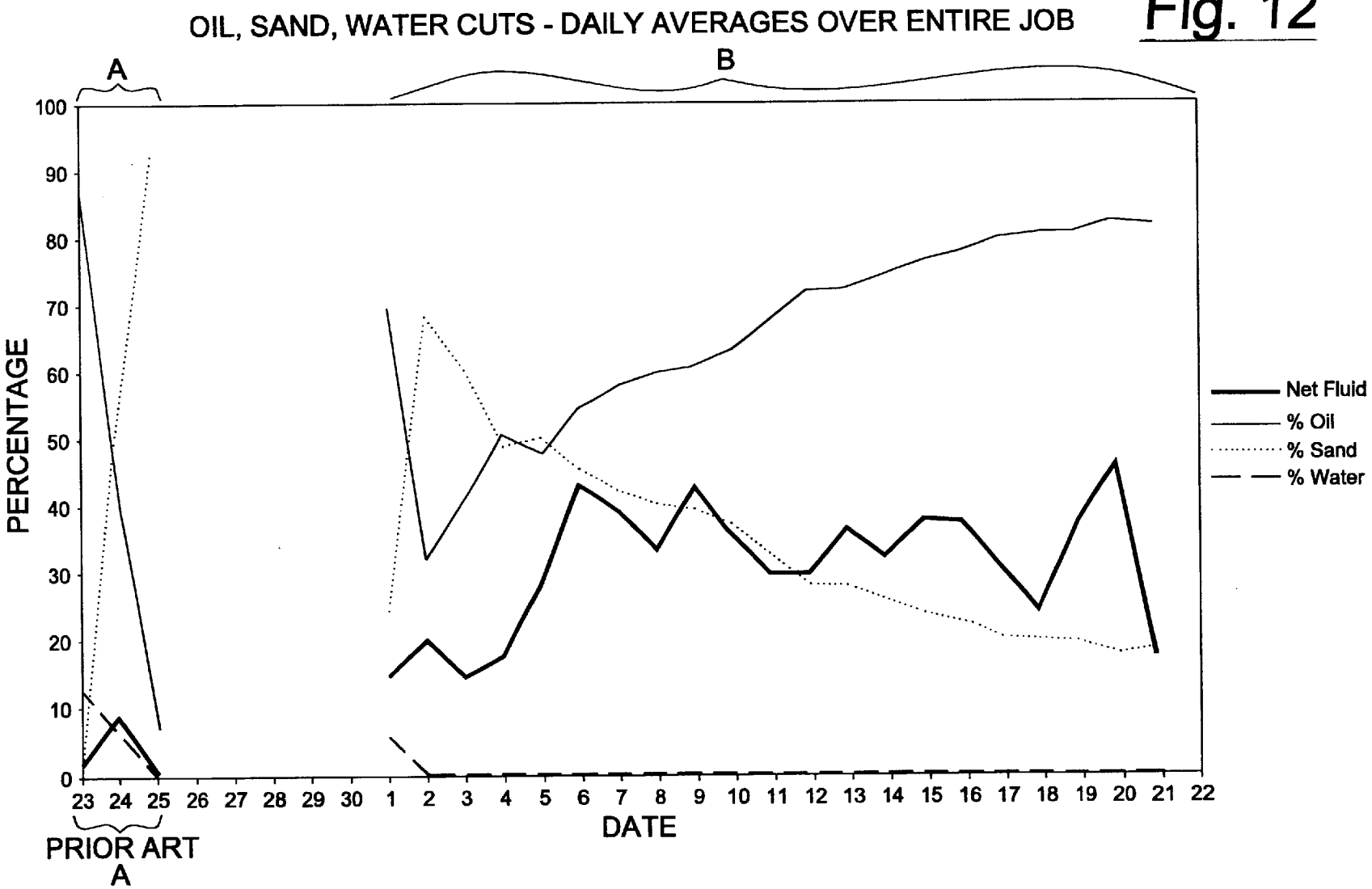
FIG. 12 is a chart depicting a comparison of the performance of a prior art converted bailer pump and a pump provided in accordance with the first embodiment and applied in Example I.

Having reference to FIG. 12 a well in Southern Alberta was run first with a competitor's commercial pump (a bailer conversion) and secondly with a pump constructed in accordance with the invention. The well was perforated at about 773 m.

As shown at A, the competitor's pump was run for only 30 hours before it sanded off. In other words, it was not removing the sand which was flowing into the well. As service rig was called in to change pumps. Upon post-operation inspection, the competitor's pump barrel and seals exhibited extreme damage.

The novel pump, according to the first embodiment, was installed. The pump was fitted to string of 3½" tubing having a 3" inside diameter. Five lengths or about 45 m of 3½" tailpipe were installed. A flapper valve was used at the bottom of the tailpipe. The piston rod was reciprocated with 3 m stroke at about 1½ to 2 strokes per minute.

As shown at B, initial oil and sand production was about 14.5 m3/d at 70% sand. The fraction of sand dropped steadily over the next 21 days to stabilize at about 17%. Correspondingly, the oil production (less sand) rose to about 82%. Over this 21 day period, about 470 m3 of oil were produced for an average of 22 m3/d. A failure of the tension anchor interrupted production. Subsequently, a further 17 days of operation were achieved (not shown), some of which were achieved with a 1¼" piece of shale wedged in the travelling valve with continued marginal production at 14 m3/d.

The pump was disassembled and inspected after the run. As stated, a 1¼ piece of shale was found wedged in the travelling valve. The barrel and piston were inspected. There were no signs of wear or seal damage from the sand.

EXAMPLE II

Two heavy oil wells, Wa and Wb were completed in Western Canada. The wells had a high gas-oil-ratio (GOR). Pumps were landed at about 800 m. Casing pressures were 713 psi and 382 respectively. Tubing pressures were 220 psi and 200 psi respectively. Well Wa had perforations at about 910 meters with a 20 degree deviation and crude gravity around 16 API. The second well Wb was a vertical well with perforations at a depth of about 880 meters, also at 16 API.

The wells were plagued with periodic sand slugs along with a combination of free water slugs. The operator could not keep well Wa pumping for more than a few days and the second well Wb for more than two weeks. Numerous bailing jobs and pump to surface jobs were performed to try and clean the sand from the wells. A progressive cavity pump was tried with no success.

An embodiment of the present invention was applied in a production pump implementation to attempt to achieve more than a few days of trouble free operation. A piston and seal assembly was provided according to FIG. 10.

First, well Wa was bailed, a pump to surface job was done to remove excess accumulated sand, and the well was put on production with a pump fitted with a short 24" tall piston and seals of the present invention. A 3¾" outside diameter by 3¼ inside diameter pump was provided, having with a 90" stroke at 3.5 strokes per minute—driven via a rod string suspended from an hydraulic pump jack. Well Wb was simply bailed and the novel pump was run with an 86" stroke and at 3 spm.

The low friction performance of the seals and large bore through the piston virtually eliminated rod fall problems. At the time of writing, the wells were still running continuously and trouble free after 54 days, and production was increased to as much as 40 m3 per day on well Wa and to 44 m3 per day on well Wb.

Before implementing a pump utilizing the present invention, a considerable amount of money was spent on flushing, bailing, pump to surface, and pump changes to no avail. After running the novel pump the operator has had no workover costs and production has increased. The average combined oil production on these two wells was about 50 m3/day. At about 80 USD per m3, the revenue was about 4,000 USD per day or 120,000 USD per month. This revenue figure does not include the savings obtained due to the elimination of several pump changes and flushing.

The embodiments of the invention in which an exclusive property or privilege is claimed are defined as follows:

1. A seal assembly for a piston which reciprocates within a cylindrical pump barrel, comprising:

(a) one or more hydraulic seal rings each having a leading edge which has at least radially inward flares;

(b) a cylindrical sleeve forming a seal annulus between said sleeve and the barrel onto which a stack of the one or more seal rings is fitted, the sleeve having a cylindrical portion with one or more circumferential and axially spaced grooves;

(c) leading and trailing retaining rings spaced axially on the sleeve, the seal ring stack residing therebetween, the height of which is less than the spacing between the leading and trailing retaining rings so as to form a gap and enable axial movement of the stack of one or more seal rings between the retaining rings so that, at a first position, the stack bears against the trailing retaining ring and the inward flares of the seal ring engaging the sleeve's cylindrical portion for forming an effective annular seal, and conversely, at a second position, the stack bears against the leading retaining ring and each inward flare engages a corresponding circumferential groove formed in the sleeve so as to lessen the radial compression on the one or more seal rings.

2. The seal assembly of claim 1 further comprising a wiper ring adjacent the end of the piston for excluding sand from the seal assembly.

3. The seal assembly of claim 2 wherein the piston has a leading end and the wiper ring has a leading edge which leads the leading end of the piston.

4. An improved piston for a pump, the piston being actuated by a reciprocating member, the pump having a cylindrical pump barrel having a fluid chamber, the piston comprising:

(a) a cylindrical piston movable axially within the barrel and forming an annulus therebetween, the piston having leading and trailing ends;

(b) a trailing seal in the annulus at the piston's trailing end for drawing a suction in the barrel's fluid chamber;

(c) a leading seal assembly in the annulus at the piston's leading end for pressuring the barrel's fluid chamber, the inlet seal comprising a stack of one or more hydraulic seal rings, each ring having a leading edge with at least a radially inward flare, the stack being fitted to a cylindrical sleeve located at the leading end of the piston, the sleeve forming an annulus between the sleeve and the barrel, the stack being axially movable between leading and trailing retaining rings spaced axially on the sleeve so that, at a first position, the stack bears against the trailing retaining ring and the inward flares of the seal rings engage and compress against the cylindrical sleeve for forming an effective annular seal, and conversely, at a second position, the stack bears against the leading retaining ring and each inward flare engages a corresponding circumferential groove formed in the sleeve so as to lessen the radial compression on each inward flare.

5. The improved piston of claim 4 wherein the trailing seal is an assembly as recited for the leading seal assembly, and wherein the leading edges of the trailing seal assembly's one or more seal rings are oriented to the piston's trailing edge.

6. The improved piston of claim 5 wherein the seal assembly further comprises one or more passageways leading from the annulus between the leading and trailing seal assemblies to the piston's bore for pressure communication therebetween.

7. A pump utilizing the improved piston of claim 4 wherein the cylindrical pump barrel fluid chamber has an inlet with a one-way standing valve at the barrel inlet for admitting fluids, further comprising:

(a) a bore through the piston and having an inlet at the piston's leading end and an outlet end at the piston's trailing end; and (b) a one-way travelling valve located in the piston bore between the piston's leading and trailing ends.

8. The pump of claim 7 wherein the cylindrical pump barrel is located in a well.

9. The pump of claim 8 wherein the cylindrical pump barrel is anchored in the well, the piston is reciprocated using a tubing string having a bore contiguous with the piston's bore.

10. The pump of claim 8 wherein the cylindrical pump barrel at the end of a tubing string having a bore contiguous with the barrel and the piston is reciprocated using a rod string extending through the tubing string.

11. A pump utilizing the improved piston of claim 5 wherein the cylindrical pump barrel fluid chamber has an inlet with a one-way standing valve at the barrel inlet for admitting fluids, further comprising:

(a) a bore through the piston and having an inlet at the piston's leading end and an outlet end at the piston's trailing end; and (b) a one-way travelling valve located in the piston bore between the piston's leading and trailing ends.

12. The pump of claim 11 wherein the cylindrical pump barrel is located in a well.

13. The pump of claim 12 wherein the cylindrical pump barrel is anchored in the well, the piston is reciprocated using a tubing string having a bore contiguous with the piston's bore.

14. The pump of claim 12 wherein the cylindrical pump barrel at the end of a tubing string having a bore contiguous with the barrel and the piston is reciprocated using a rod string extending through the tubing string.

* * * * *